US005446984A

United States Patent [19]

Kulp et al.

[11] Patent Number: 5,446,984

[45] Date of Patent: Sep. 5, 1995

[54] HIGHWAY SIGNS CAPABLE OF BEING ROLLED UP AND IMPROVED MOUNTING BRACKETS FOR THE SIGNS

[75] Inventors: Jack H. Kulp, San Juan Capistrano, Calif.; John D. McKenney, Arroyo Seco, N. Mex.; James P. Sullivan, Orange, Calif.

[73] Assignee: TrafFix Devices, Inc., San Clemente, Calif.

[21] Appl. No.: 115,908

[22] Filed: Sep. 1, 1993

[51] Int. Cl.[6] ..... G09F 15/00

[52] U.S. Cl. ..... 40/610; 40/603; 248/219.2; 248/224.7

[58] Field of Search ..... 40/603, 606, 610; 248/219.2, 316.1, 314, 224.3, 221.3

[56] References Cited

U.S. PATENT DOCUMENTS

| | | | |
|---|---|---|---|
| 1,390,736 | 9/1921 | Wadsworth . | |
| 1,485,846 | 3/1924 | Griffin . | |
| 1,699,735 | 1/1929 | Dabrohua et al. . | |
| 1,873,178 | 8/1932 | Bernstein . | |
| 2,160,426 | 5/1939 | Archer . | |
| 2,484,096 | 10/1949 | Kay . | |
| 3,143,817 | 8/1964 | Paulson . | |
| 3,200,786 | 8/1965 | Swezy et al. . | |
| 3,526,200 | 9/1970 | Doyle | 40/606 X |
| 4,426,800 | 1/1984 | Brown . | |
| 4,490,934 | 1/1985 | Knapp . | |
| 4,507,887 | 4/1985 | Seely | 40/606 |
| 4,798,356 | 1/1989 | Alonso | 40/606 X |
| 4,888,894 | 12/1989 | Brown . | |
| 4,980,984 | 1/1991 | Kulp et al. . | |

FOREIGN PATENT DOCUMENTS

| | | | |
|---|---|---|---|
| 9110986 | 7/1991 | WIPO | 40/610 |

OTHER PUBLICATIONS

1975–1976 Modern Plastics Encyclopedia, Plastic Properties Chart on p. 480.

*Primary Examiner*—Ramon O. Ramirez
*Assistant Examiner*—Derek J. Berger
*Attorney, Agent, or Firm*—Edward J. DaRin

[57] ABSTRACT

A mounting bracket or socket for use with a flexible highway sign capable of being rolled up for storage and portability. The mounting bracket being molded from a non-rigid, elastic material that is reasonably transparent and having a socket for accommodating a frame member for the highway sign in a non-rotatable relationship. The plastic bracket including a securing platform integrally molded therewith for securing the bracket to the highway sign. A reinforcing member of substantially the same length as the mounting bracket for clamping the highway sign between the bracket and the reinforcing member. The sign engaging surfaces of the bracket and the reinforcing member each include tear resistant elements for clamping the sign to thereby transfer the sign tearing load from the fastener securing the bracket and reinforcing member to the highway sign.

19 Claims, 4 Drawing Sheets

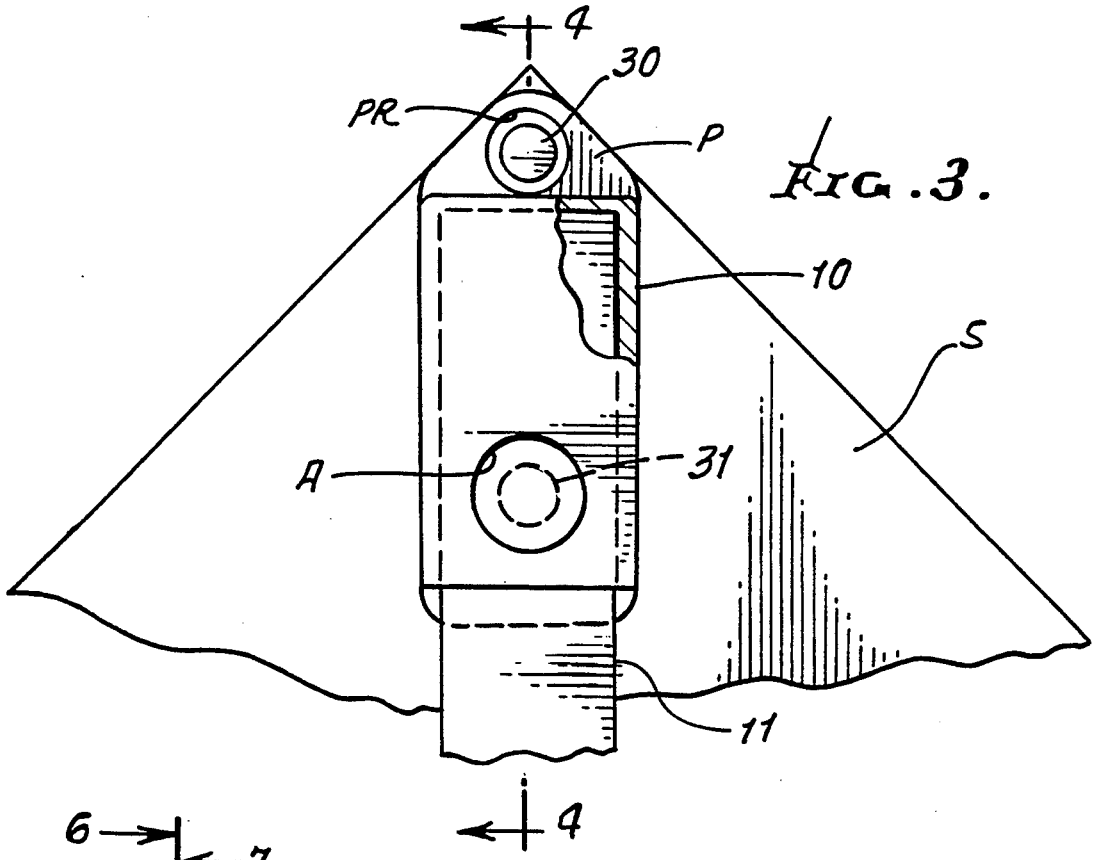
FIG. 3.
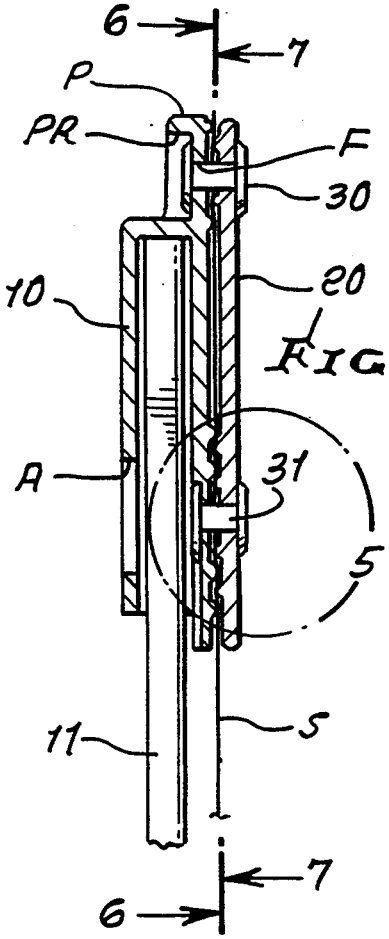
FIG. 4.
FIG. 7.
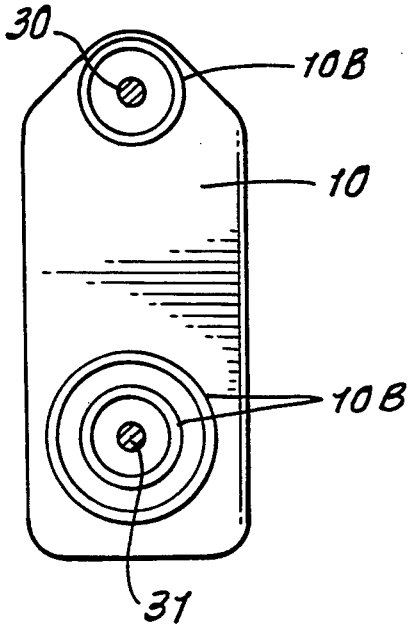

HIGHWAY SIGNS CAPABLE OF BEING ROLLED UP AND IMPROVED MOUNTING BRACKETS FOR THE SIGNS

FIELD OF INVENTION

This invention relates to highway signs and more particularly to flexible, advance warning highway signs capable of being disassembled and rolled up for convenience of storage and for transport.

BACKGROUND OF INVENTION

Flexible, temporary highway signs for advance warning to a motorist of an approaching unsafe driving area or construction site are well-known in the art and is exemplified by U.S. Pat. No. 4,980,984 granted on Jan. 1, 1991. The highway signs under consideration are constructed of flexible fabrics, such as plastic mesh materials or reflective vinyl and polyethylene materials in the form of polyethylene or vinyl plastics some of which have fluorescent materials embedded therein. These highway signs are preferably maintained in a display position vis-a-vis a storage position by means of reinforcing frame members constructed of flexible plastic materials that allow the sign and the reinforcing members to bend on their stand through a substantial angle, without tipping over in response to winds or wind gusts created by motor vehicles and the like. The reinforcing frame members may be removably secured to the flexible sign by means of "corner" pockets that are either "soft" pockets sewed on the sign itself or molded plastic members defining a socket and secured to the sign for removably securing the ends of the frame members. The soft cloth pockets were supplanted by the molded plastic "corner" pockets. One such molded plastic socket is disclosed in U.S. Pat. No. 4,426,800 granted on Jan. 24, 1984. The molded plastic type of corner pocket is preferably in the configuration produced and sold by the Bone Safety Corporation of Marrieta, Ga. and the Reflexite Corporation of New Britain, Conn. that is constructed of a rigid polycarbonate material. This type of molded plastic device is utilized in the highway sign of the aforementioned U.S. Pat. No. 4,980,984 as discussed therein. The polycarbonate corner pockets have been found to be inelastic or rigid and brittle thereby being subject to being cracked or shattered in use. A further embodiment of the rigid "corner" pocket is disclosed in U.S. Pat. No. 4,490,934 granted on Jan. 1, 1985. This later mentioned type of rigid "corner" pocket is alleged to eliminate the need of flexing the flexible sign reinforcing members for the flexible highway signs for insertion into the "corner" pockets.

When the rigid "corner" pockets are utilized with flexible sign reinforcing members of the type of glass reinforced polyester, plastic pulltrusions, commercially available, they can be bent through approximately a 90 degree angle without breaking and will spring back to their original straight position; see prior art U.S. Pat. No. 4,980,984 noted hereinabove at column 4, for example. Experience with the use of rigid "corner" pockets have revealed that with the continuous flexing of the sign material the single point of connection commonly utilized to secure the rigid pocket to the flexible signs material breaks through the securement end of the "corner" pocket and tears a hole in the highway sign. The flexing of the highway sign in use under wind loads such as when the flexible reinforcing members are either installed into the rigid pockets and flexing back and forth in the wind or during disassembly therefrom, results in the outside corner of the "corner" pocket functioning as a pivot point that is jammed against a hard supporting surface in the assembly or disassembly of a sign or jammed into the sign stands as disclosed in U.S. Pat. No. 4,888,894 granted on Dec. 26, 1989 or jammed into its storage container, all leading to tearing away the securing fastener for the rigid pocket. To the same end when the assembled highway sign is in use and continuously flexes due to the prevailing winds and the like, the sign has been found to flex about the free corners of the rigid hard pockets whereby tears or punctures in the sign materials results therein such as in the polyethylene mesh and vinyl plastic materials in common usage. These problems, then, with the use of present day "corner" pockets constructed of rigid materials shorten the useful life of the highway signs and corner pockets. Accordingly, there is a present need for an improved mounting bracket or "corner" pocket that is not constructed of a rigid material or a soft material, such as a cloth material, that has an extended life when used with present day, flexible advance warning signs and does not reduce the useful life of the warning sign.

SUMMARY OF INVENTION

The present invention provides an improved mounting bracket for use with a flexible highway sign or the like for receiving and removably securing an end of a frame member for the highway sign that overcomes the problems experienced with the present day rigid mounting brackets through the use of a non-rigid, elastic plastic, without any sharp corners and preferably being molded of a polyurethane material or the like. The polyurethane type of material selected is also constructed and defined with tear resistance rings on both the mounting brackets and the reinforcing plate therefore for clamping a highway sign therebetween that restricts the relative movement between the highway sign and the mounting bracket. The mounting bracket is further molded with walls of a preselected thickness along with a securing platform having a preselected thickness greater than the preselected thickness for the walls of the mounting bracket to better withstand the impact forces subjected to the highway sign during the erection and disassembly of the highway sign including with a portable sign stand leading to the tearing of the sign.

From a broad structural standpoint, the present invention comprises a mounting bracket molded from a non-rigid plastic material, such as polyurethane, that is defined with a fastener securing platform formed integrally with the mounting bracket of a preselected thickness to permit fastening the highway sign thereto for minimizing tearing of the highway sign. The mounting bracket is used with a reinforcing member constructed of the same plastic material as the bracket. To further reduce the tearing of the highway sign, the mounting bracket and the reinforcing member are provided with tear resistant rings arranged on the sign engaging surfaces to clamp the sign in an interdigital fashion adjacent the points of securement to the highway sign. The mounting bracket is constructed and defined with a sign mounting aperture to be mounted to present day, portable sign stands.

BRIEF DESCRIPTION OF THE DRAWINGS

These and other features of the present invention may be more fully appreciated when considered in the light of the following specification and drawings, in which:

FIG. 3 is a partial, rear elevational view with a portion broken off of one corner of the highway sign of FIG. 2 showing the corner pocket of the present invention secured thereto and securing a frame member;

FIG. 4 is a cross-sectional view of the highway sign taken along the line 4—4 of FIG. 3;

FIG. 7 is a view taken along the line 7—7 of FIG. 4;

DETAILED DESCRIPTION OF THE PREFERRED EMBODIMENT

Figure 1:
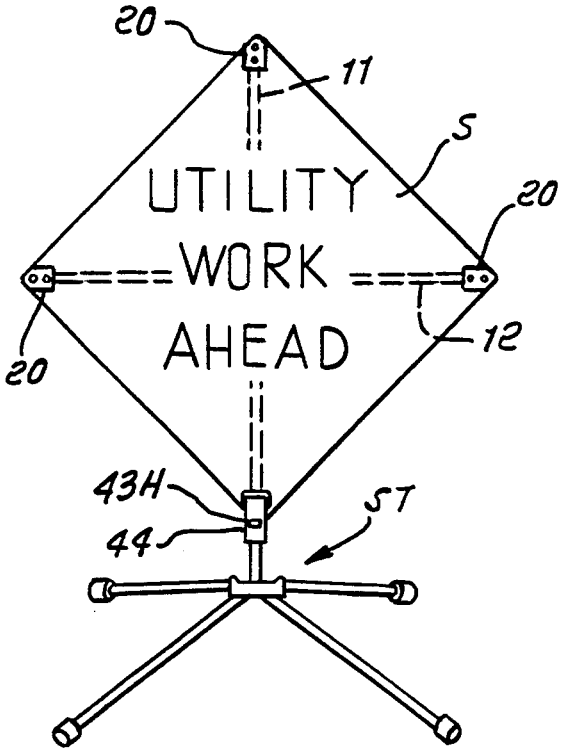
FIG. 1 is a front elevational view of the highway safety sign mounted on a sign stand and embodying the present invention.

Now referring to the drawings, the presently preferred embodiment of the mounting bracket 10 used with the highway signs S or the like will be described. The highway sign S is illustrated in FIG. 1 in its display position with an appropriate highway safety message to be viewed by motorists. The highway sign S is provided with a mounting bracket 10, commonly referred to as a "corner" pocket, secured to each corner of the diamond shaped sign and mounting sign reinforcing frame members 11 and 12 secured to the mounting brackets 10 on the non-display side of the sign S. The highway sign S arranged in its message display position is mounted to a highway sign stand ST of known commercial configuration that may be readily folded for transport and unfolded for mounting the highway sign S thereon as illustrated in the drawing. U.S. Pat. No. 4,888,894 granted on Dec. 26, 1989 discloses a sign stand of the type described hereinabove. The traffic stand ST is particularly adapted to secure the sign S by means of one of the mounting brackets 10 when secured to the highway sign S for readily mounting and unmounting the sign S to the stand ST, as will be described more fully hereinafter.

Figure 2:
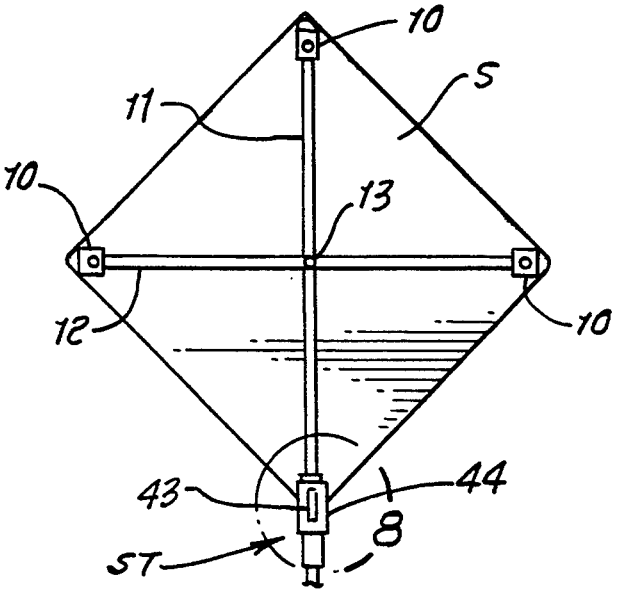
FIG. 2 is a partial, rear elevational view of the highway safety sign of FIG. 1.

Now referring to the highway sign S per se, it will be known that the signs per se are of a commercially available construction and presently are constructed of a lightweight, flexible material, such as reflective vinyl or polyethylene plastic and a fluorescent mesh that permits the sign to be readily rolled up for storage so as to keep the sign and the safety legend compact and in a good condition. The signs S are usually 36 by 36 inches or 48 by 48 inches in size and mounted at one corner to give it a diamond construction work zone appearance. The reinforcing frame members 11 and 12 are preferrably constructed of a flexible material that will allow the upstanding sign S to respond to winds or wind gusts impinging thereon, without breaking or tipping over the sign stand ST and returning to its original substantially vertical position without taking a set, as the winds or wind gusts subside. The reinforcing members 11 and 12 are preferably constructed of glass reinforced polyester, plastic pulltrusions that are commercially available. The frame members 11 and 12 are pivotably secured at their center points by a fastener 13; see FIG. 2. The pivotable securement of the frame members 11 and 12 allows them to be pivoted and rotated about the fastener 13 to a side by side relationship when detached from the mounting brackets 10 to permit the sign S to be rolled around the vertical frame member 11 for transport and storage purposes. The selection of the glass reinforced polyester plastic pulltrusions for the members 11 and 12 permits the frame members to bend through approximately a 90 degree angle without breaking and to spring back to their original position. This allows the frame members 11 and 12 to be bent when mounting the ends of the members 11 and 12 into their individual mounting brackets 10 for setting up the sign S as well as being advantageous in responding to winds and/or tipping forces.

The mounting brackets 10 for receiving and securing the end of a frame member is preferably molded of a preselected non-rigid, elastic plastic such as polyurethane material without any sharp corners to prevent the sharp corners from digging into the flexible sign S leading to tearing thereof. The selection of the polyurethane plastic is based on the requirements for a cold temperature impact resistant, reasonably soft and pliable vis-a-vis, a rigid material, such as a polycarbonate material, and one that is reasonably transparent so as not to block the visability of the sign and any marking thereon. To this end, the mounting brackets 10 are molded from thermoplastic urethanes or polyurethanes ranging in hardness from 65A-80D(shore), Rockwell hardness based on the D75 test method of the American Society Test Methods; all as described in the 1975–1976 Modern Plastics Encyclopedia on page 488. There is no present, known use of the thermoplastic urethanes for corner pockets to achieve the desired results of the corner pockets 10 of the present invention.

The mounting bracket 10 is a molded plastic member of a plastic of the aforementioned type and having a single open end for defining an entry to the socket for a reinforcing member and a preselected depth relative to the end of a frame member extended into and fitting into the thus defined socket and with a preselected width to accommodate the frame member to hold a tensioned frame member therein from turning within the socket when mounted to reinforce the highway sign S; see FIG. 3. The mounting bracket 10 is used with a reinforcing plate 20 molded of the same plastic as the bracket 10 and secured to the opposite side of the sign S from the bracket 10, to sandwich the sign S in between; see FIG. 4. The reinforcing plate 20 is coextensive in length and width with the bracket 10. The reasonably transparent clear plastic is important for the reinforcing member 20 since it is mounted on the display side of the sign S. As contrasted with present day, rigid brackets, the bracket 10 of the present invention is molded from the preselected plastic with four quadrilateral walls of a preselected thickness so as to have a closed end and a single open end for receiving an end of a reinforcing frame member within the thus defined socket defined by the four walls and a substantially triangular securing platform P formed integrally with the mounting bracket at the closed end thereof, opposite to the open end, for securement to a corner of the sign S by fastening means.

Figure 5:
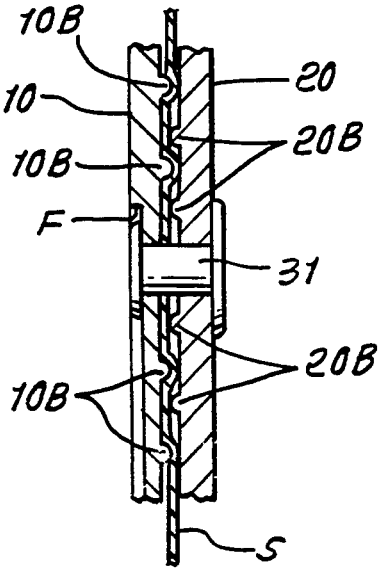
FIG. 5 is an enlarged view of the portion of FIG. 4 encircled and identified as 5.

The securing platform P is selected to have a thickness greater than the thickness of the four walls defining the mounting socket and on the order of four times the thickness of prior art mounting brackets to prevent the sign fastening means from breaking through the mounting platform P and tearing the sign S. To further prevent this breakage at the securing platform P of the fastening means, the platform is defined with a recessed aperture PR to accommodate a fastener with a coaxial aperture extending through the platform P to accommodate a fastener as best seen in FIG. 4. The mounting bracket 10 is also provided with a circular mounting aperture A on the top wall of the bracket 10 spaced adjacent the open end of the bracket and coaxial with a recessed aperture F to accommodate fastening means. The reinforcing plate 20 is provided with a pair of fastening apertures longitudinally spaced and axially aligned with the apertures PR and F for receiving fastening means. A presently preferred fastening means are pop rivets 30 and 31 extending through the apertures for the platform P and the aperture F to secure the sign S in a sandwiched relationship with the reinforcing plate 20, as best seen in FIGS. 4 and 5.

Figure 6:
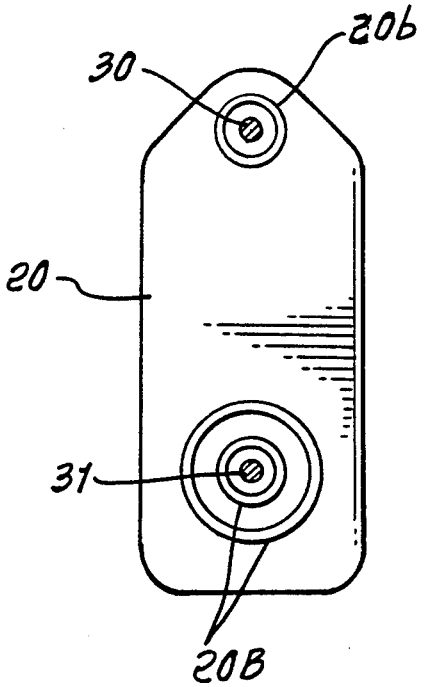
FIG. 6 is a view taken along the line 6—6 of FIG. 4.

A further feature of the mounting brackets 10 of the present invention is the provision of tear resistant clamping beads for both sign engaging surfaces of the bracket 10 and the reinforcing plate 20. In FIGS. 4 and 5, the bracket 10 and reinforcing plate 20 are illustrated in assembled relationship with the spaced tear resistant, circular beads 10B for the mounting bracket 10 and the spaced tear resistant circular beads 20B for the reinforcing plate 20 so that the spacing of beads 10B and 20B engage the sign S in an interdigital clamping relationship. This relationship of the beads 10B and 20B clamps the adjacent portions of the sign S and are effective to transfer any tearing load on the sign S from the fastening means or in this instance, the rivets 30 and 31. The sign engaging surface of the reinforcing plate 20 is illustrated in FIG. 6. The plate 20 is designed and constructed so that the tear resistant beads 20B are concentric with the fastening apertures receiving the rivets 30 and 31, as illustrated. A single fastening bead 20B is provided at the substantially triangular end of the plate 20, while a pair of clamping beads 20B are arranged in concentrically, spaced relationship with the fastening aperture receiving the rivet 31. Similarly, the sign engaging surface of the bracket 10 is provided with the same spaced arrangement of circular clamping beads 10B as is evident from FIG. 7. The clamping beads 10B and 20B protrude outwardly of the surfaces for the bracket 10 and plate 20 on the order of 0.020 inches. The reason a plurality of clamping beads are provided adjacent one end of the bracket 10 and plate 20, the non-triangular end, is that when assembled as in FIG. 4, for example, the unclamped portion of the sign adjacent the rivet 31 tends to flex around the rivet in use leading to the tearing of the sign S and the assembled relationship of the beads transfers the resulting sign tearing load from the rivets leading to a longer life for the assembled sign S and the mounting bracket 10 and reinforcing plate 20.

Figure 8:
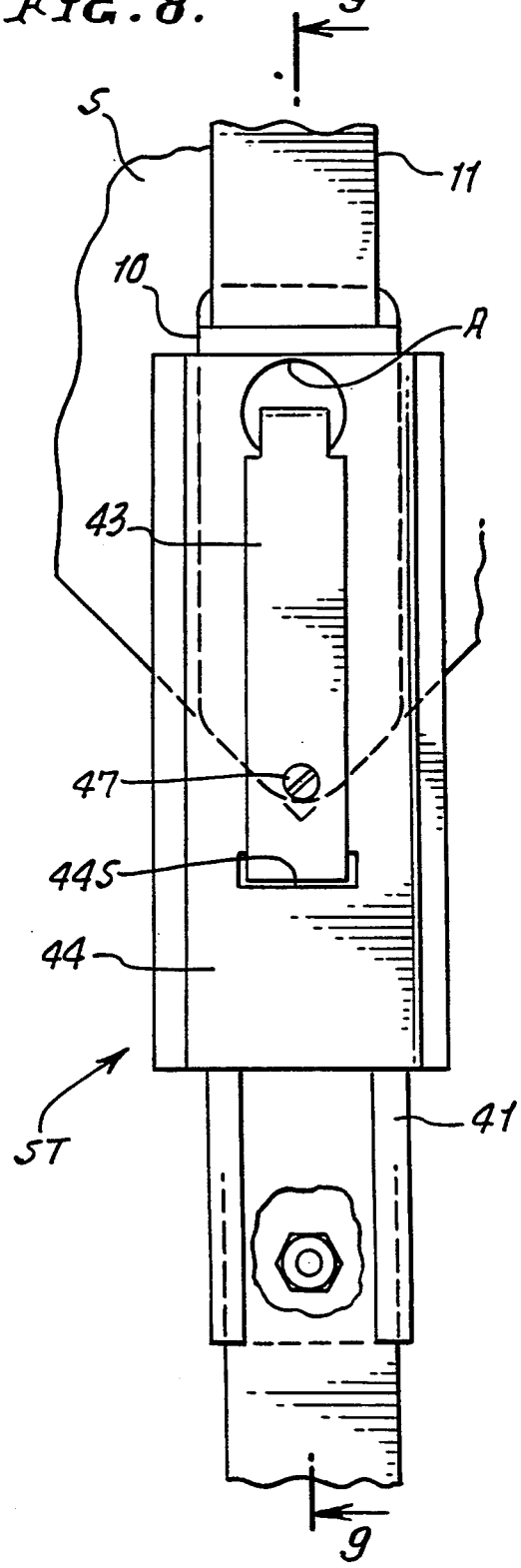
FIG. 8 is an enlarged view of the portion of FIG. 2 encircled and identified as 8.
Figure 9:
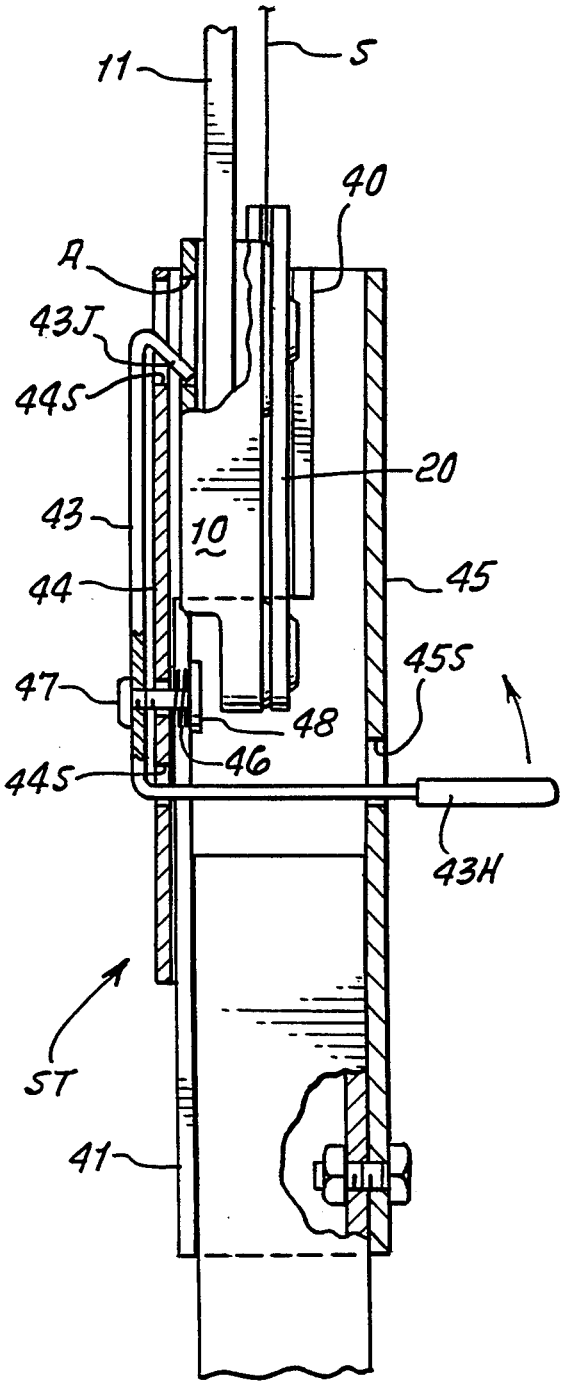
FIG. 9 is a view taken along the line 9—9 of FIG. 8.

Now referring to FIGS. 8 and 9, the advantage of selecting and utilizing a non-rigid material for the bracket 10 and the plate 20 can be better appreciated when it is understood how a mounting bracket 10 and plate 20 secured to a sign S is mounted, by jamming, into the mounting socket for the sign stand ST. The top end of the sign stand ST is illustrated in FIGS. 8 and 9 to illustrate how the assembled sign S is held therein. The sign stand ST is constructed and defined at its upper end with a sign attaching socket 40 secured to the support housing 41 for the sign stand ST. The socket 40 is securely secured to the support housing 41 so as to bear the weight of the sign S when assembled thereto. The detailed description of the sign stand per se is described in U.S. Pat. No. 4,888,894 and which disclosure is incorporated herein by reference. The open end of the socket 40 is adapted for receiving the sign S carrying the assembled mounting bracket 10 and reinforcing plate 20 at the lower end of the sign S when arranged as in FIG. 1 for display purposes. The socket 40 is constructed and defined with slots (not shown) on the opposite sides of the socket 40 so as to accommodate the sides of the sign S immediately adjacent the mounting bracket 10, see FIG. 8. A hook 43J is movably mounted to the socket 40 for securing the sign S in the stand ST at the bracket 10. As best seen in FIG. 9, the hook 43J is illustrated in the form of an inverted J structure formed at the free end of a plate 43 resting against the outer surface of one member 44 defining the left hand side of the socket 40, as illustrated in FIG. 9. The member 43 is bent at a right angle to extend through the slot 44S for the member 44 and through the slot 45S for a member 45 defining the opposite side of the socket 40. The free end of member 43 that extends outwardly of the slot 45S may have a handle 43H for manually moving it in a counter-clockwise motion. The hook 43J and the plate 43 resting on the plate 44 are mounted by means of a spring 46 to normally cause the hook 43J to be within the socket 40 when the handle 43H is at rest. The spring 46 is mounted on a fastener 47 carrying a spring seat 48 so as to reside between the seat 48 and the inner wall of the member 44 as illustrated. The hook 43J extends into the socket 40 through an aperture 44S provided for the upper end of the member 44. In its normal position, the hook 43J prevents the sign S to be accommodated within the socket 40. The operation of the handle 43H in a counter-clockwise direction causes the spring 46 to be compressed and the hook 43J to be withdrawn from the socket 40 and the aperture 44S. At this time, the mounting bracket sign assembly may be moved into or removed from the socket 40. The mountings arrangement is such that the mounting bracket 10 carrying the sign S has the corner of the sign inserted into the socket 40 for mounting on the stand. With the bracket 10 fully within the socket 40, the mounting aperture A on the bracket 10 will be aligned with the hook 43J so as to permit it to move into engagement with the aperture A to thereby hold the sign S in the stand ST. At this time, the release of the handle 43H will cause the hook 43J to move into the socket 40 and into engagement with the aperture A of the mounting bracket 10, as best seen in FIG. 9. When the sign S is mounted to the sign stand ST as illustrated in FIG. 1, the operation of the handle 43H will release the bracket 10 from the hook 43J to permit the sign S to be withdrawn from the sign stand ST.

In the usual mounting procedure of the sign S into the socket 40 for the sign stand ST, the user can jam the mounting bracket into the socket 40 for moving the hook 43J out of the path of the bracket 10 for complete insertion into the socket 40. This jamming action can damage the triangular end of a mounting bracket 10 and the securing rivet unless the mounting bracket is designed in accordance with the concept of the present invention. This same jamming of the mounting bracket 10 results when a reinforcing member is to be mounted into the bracket and is jammed against a hard supporting surface for the tensioning of a reinforcing member.

Figure 10:
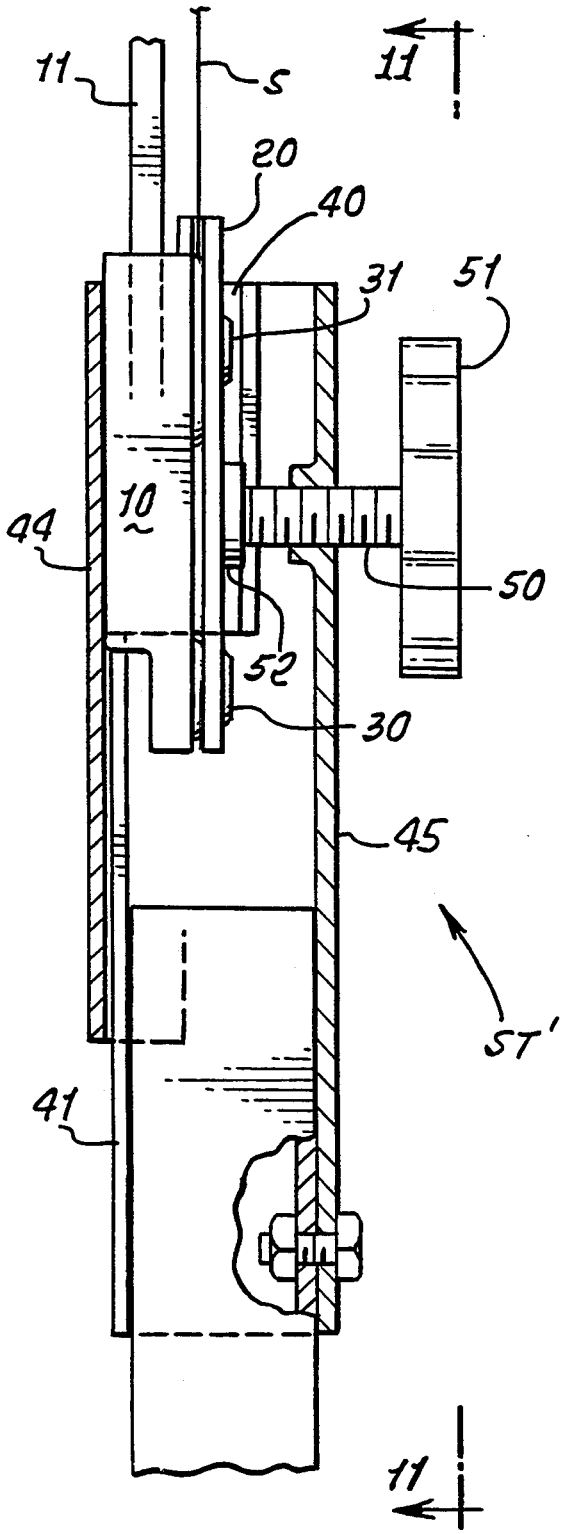
FIG. 10 is an enlarged view similar to FIG. 8 illustrating a modified sign stand.
Figure 11:
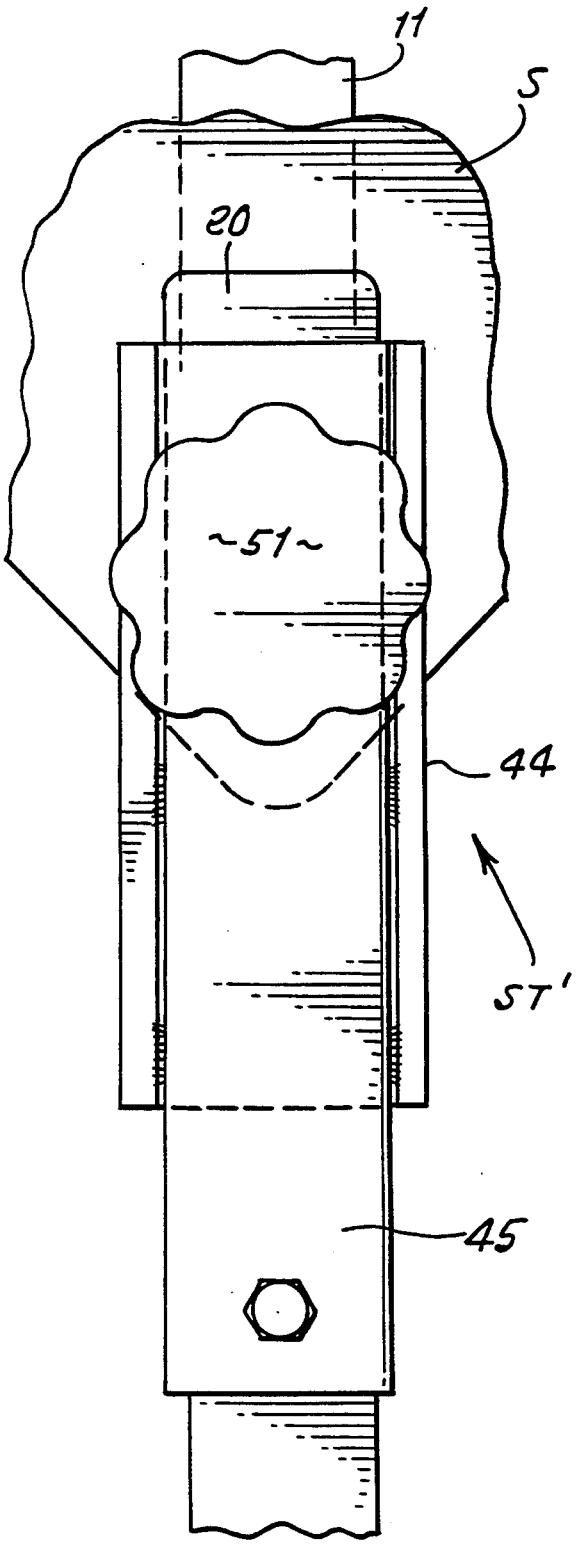
FIG. 11 is a view taken along the line 11—11 of FIG. 10.

Now referring to FIGS. 10 and 11, an improved sign stand ST′ is the same as the sign stand ST except that the hook 43J and the operating member 43 for operating the hook out of the socket 40 may be omitted as superfluous. It should be recognized that although these members may be omitted, the modified sign stand ST′ may include these elements and merely add the structure for securely holding the mounting bracket 10 in the sign stand ST′. To this end, it should be noted that the arrangement illustrated in FIGS. 8 and 9, the bracket 10 is held loosely in the opening 40 by the hook 43J engaging the aperture A of the bracket 10. This arrangement may cause the hook 43J to become disengaged with subsequent damage to the sign 10. To prevent the relative movement of the bracket 10 in the sign stand opening 40, it is desired to tightly secure the bracket 10 to the sign stand ST′, as illustrated in FIGS. 10 and 11. For this purpose releasable fastening means is provided on the opposite side of the stand ST′ from the position of the hook 43J. The releasable fastening means is illustrated in the form of a threaded member 50 rotatably secured to the member 45 and having a manually operative handle 51 for rotating the fastener 50 in both directions. The inner end of the fastener 50 carries a stop member 52 for engaging the plate 20 for bracket 10 positioned in the opening 40 for the stand ST′. As illustrated in FIG. 10, the handle 51 has been rotated to tightly engage the reinforcing plate 20 for the bracket 10 to firmly hold the bracket and sign in the sign stand ST′. The bracket 10 can be released by rotating the handle 51 and thereby the fastener 50 in a counterclockwise direction to move the stop 52 away from the plate 20 thereby permitting the bracket 10 and the sign S to be disengaged from the sign stand ST′.

It should now be appreciated by those skilled in the art of flexible highway signs that are capable of being rolled up that an improved mounting bracket has been disclosed that can be molded from a plastic material that is not rigid and not susceptible to cracking and breaking but that is reasonably soft and pliable that extends the life of a highway sign used therewith. The mounting bracket per se is improved by molding it and the reinforcing plate therefor from a polyurethane material or the like along with sign tear resistant features that minimizes tearing the sign as well as the fasteners and the bracket mounting structure for the fasteners. The sign stand has been modified to securely hold the sign mounting bracket and the sign in the sign stand.

We claim:

1. A mounting bracket for use with a flexible highway sign or the like for receiving and removably securing an end of a frame member for the highway sign, said mounting bracket being molded and defined by quadrilateral walls of preselected thickness having a closed end and a single open end for receiving an end of a frame member within the socket confined by said four walls, and a securing platform formed integrally with the mounting bracket at the end opposite to the open end and having a preselected thickness greater than the thickness of said quadrilateral walls for permitting said sign to be secured at said securing platform, said preselected thickness for the securing platform being selected to withstand the impact forces subjected to the highway sign during the erection, disassembly and storage of the highway sign, said mounting bracket being constructed of a molded polyurethane material, and a reinforcing member constructed of the same polyurethane material as said mounting bracket and defined to be coextensive with the bracket and the securing platform when secured to the opposite side of said sign from the mounting bracket.

2. A mounting bracket for use with a flexible highway sign or the like for receiving and removably securing an end of a frame member for the highway sign, as defined in claim 1 wherein said securing platform for the mounting bracket has a substantially triangular configuration and formed with a recessed mounting aperture for receiving a fastening element and said reinforcing member having a triangular end to overlie said triangular platform when mounted on the opposite side of said sign from the mounting bracket for clamping the sign between the reinforcing element and the mounting bracket whereby the mounting bracket and said reinforcing member may be secured to a corner of the highway sign by fastening means.

3. A mounting socket for use with a flexible highway sign or the like for receiving and removably securing an end of a frame member for reinforcing the highway sign, said mounting socket comprising a molded plastic member having a single open end for defining the entry to the socket and a preselected depth relative to the ends of a frame member extended into and fitting the thus defined socket along with a preselected width to accommodate the frame member to hold the extended frame member from turning within the socket when the frame member is mounted to reinforce the highway sign, the plastic member being preselected from a non-rigid, elastic plastic and including means molded integrally with said socket adjacent an end thereof adapted for securing the socket to a flexible highway sign in a non-tearing relationship and an aperture arranged on the socket adjacent the opposite end from said securing means for providing access to the inside of the socket for further securing the socket to said sign.

4. A mounting socket as defined in claim 3 including a reinforcing member having substantially the same length as the mounting socket to be secured to the opposite side of the sign from said socket for clamping the sign between the socket and the reinforcing member.

5. A mounting socket as defined in claim 4 wherein said reinforcing member is molded from the same plastic as said molded socket.

6. A mounting socket as defined in claim 5 wherein said molded socket and reinforcing member each includes tear resistant means constructed and designed on the sign engaging surfaces of said mounting socket and coacting with the reinforcing member surface having tear resistant means for clamping the sign there between and thereby transferring the sign tearing load from a fastener securing the sign.

7. A mounting socket as defined in claim 6 wherein said tear resistant means comprises a plurality of spaced apart clamping elements formed with said securing means and said reinforcing means.

8. A mounting socket as defined in claim 6 wherein said tear resistant elements are each integrally molded with said mounting socket and said reinforcing element to engage a sign in an interdigital relationship.

9. A mounting socket as defined in claim 8 wherein said means for securing said socket to said highway sign includes a recessed aperture having a pre-selected depth and diameter for receiving fastening means and an aperture in coaxial alignment with said recessed aperture for said socket and having a smaller diameter than said recessed aperture and extending through said securing means for accommodating fastening means therein.

10. A mounting socket as defined in claim 9 wherein said reinforcing element includes apertures thereon arranged in coaxial relationship with the securing apertures for said mounting socket.

11. A mounting socket as defined in claim 10 wherein said tear resistant elements are integrally molded adjacent said apertures for the reinforcing element and said mounting socket.

12. A mounting socket as defined in claim 10 wherein said tear resistant elements comprise ring means extending outwardly from the sign engaging sides of the reinforcing plate and the mounting socket adjacent said securing apertures.

13. A mounting socket as defined in claim 12 wherein one end of said mounting socket and said reinforcing member each are molded with a substantially triangular configuration for accommodating a corner of said highway sign and the aligned apertures for said mounting socket and said reinforcing member are provided with a plurality of spaced, tear resistant rings to interdigitally engage said sign when the mounting socket and reinforcing member are secured to opposite sides thereof.

14. A reinforced, flexible highway safety sign capable of being rolled up for storage and portability comprising a flexible message panel having a quadrilateral configuration capable of being rolled up for storage or transporation and rolled open to assume a substantially flat displaying configuration, bracket means secured adjacent each corner of said message panel, the bracket means being molded and defined from a preselected non-rigid, pliable reasonably transparent plastic and including means molded integrally with said bracket means adjacent an end thereof adapted for securing the bracket means to a flexible highway sign in a non-tearing relationship and an aperture arranged on the bracket means adjacent the opposite end from said securing means for providing access to the inside of the bracket means including for further securing the bracket means to said sign and defined for receiving in a non-rotable relationship an end of each of a pair of flexible sign reinforcing members on the non-message side of the message panel, a pair of flexible sign reinforcing members pivotally secured to one another intermediate their ends for permitting the members to be pivotally folded between a side by side position, and to be pivotally unfolded to an orthogonally related open relationship, one end of each of said reinforcing members being removably mounted in an individual bracket means for the flexible message panel to cause the message panel to assume a substantially flat message displaying configuration, the reinforcing member being constructed and defined with sufficient stiffness to normally maintain the flexible message panel in an upright message displaying position and yet sufficiently flexible to be flexibly responsive to winds and wing gusts impinging thereon to tilt in accordance with the strength of said winds without breaking or becoming physically distorted and to return to its upright position upon the cessation or diminution of the winds or wind gusts.

15. A reinforced, flexible highway safety sign as defined in claim 14 wherein said bracket means are molded from a preselected polyurethane plastic.

16. A reinforced, flexible highway safety sign as defined in claim 14 or 15 wherein said reinforcing members are constructed of a pulltruded, glass reinforced plastic.

17. A reinforced, flexible highway safety sign as defined in claim 15 including a bracket reinforcing member secured to the other side of the message panel from said bracket means and clamping the message panel therebetween.

18. A reinforced, flexible highway safety sign as defined in claim 17 including a foldable sign stand constructed and defined to assume an upright sign mounting position and adapted to receive and secure one of said bracket means for releasably mounting the message panel in an upright position.

19. A reinforced, flexible highway safety sign as defined in claim 18 wherein said bracket means includes an aperture arranged adjacent one end for securement to said sign stand, said sign stand being constructed and defined with open end for receiving a bracket means secured to a highway sign therein, said sign stand including a movable hook adapted to normally reside in said open end of the sign stand and to be pivoted outside of said open end to permit said bracket means to be accommodated in said open end of the sign stand and to pivot into said aperture of the bracket means for securing the sign stand to said bracket means.

* * * * *